US009169039B2

(12) United States Patent
Freeman

(10) Patent No.: US 9,169,039 B2
(45) Date of Patent: Oct. 27, 2015

(54) DISPLAYABLE SHIPPING CONTAINER

(71) Applicant: PACKAGING CORPORATION OF AMERICA, Lake Forest, IL (US)

(72) Inventor: Paul M. Freeman, Branchburg, NJ (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 14/453,279

(22) Filed: Aug. 6, 2014

(65) Prior Publication Data

US 2015/0041363 A1 Feb. 12, 2015

Related U.S. Application Data

(60) Provisional application No. 61/863,070, filed on Aug. 7, 2013.

(51) Int. Cl.

| | |
|---|---|
| ***B65D 5/52*** | (2006.01) |
| ***B65D 5/54*** | (2006.01) |
| ***B65D 5/72*** | (2006.01) |

(52) U.S. Cl.
CPC *B65D 5/52* (2013.01); *B65D 5/542* (2013.01); *B65D 5/722* (2013.01)

(58) Field of Classification Search
CPC ..... B65D 5/52; B65D 5/542; B65D 5/722
USPC ..... 229/221, 122, 122.1, 121; 206/766, 206/738; 220/525; 221/305
See application file for complete search history.

(56) References Cited

U.S. PATENT DOCUMENTS

| | | | |
|---|---|---|---|
| 177,279 | A | 5/1876 | Ritter |
| 598,087 | A | 2/1898 | Harker |
| 632,222 | A | 8/1899 | Malatesta |
| 1,114,042 | A | 10/1914 | Richardson |
| 1,142,020 | A | 6/1915 | Carver |
| 1,194,372 | A | 8/1916 | Fischer |
| 1,367,048 | A | 2/1921 | Horr |
| 1,472,953 | A | 11/1923 | Bamber |
| 1,551,774 | A | 9/1925 | Reeves |
| 1,558,494 | A | 10/1925 | Newton |
| 1,609,186 | A | 11/1926 | Peruzzi |

(Continued)

OTHER PUBLICATIONS

PCT Search Report for International Application No. PCT/US2014/049952 dated Nov. 5, 2014 (2 pages).

(Continued)

*Primary Examiner* — Steven A. Reynolds
(74) *Attorney, Agent, or Firm* — Nixon Peabody LLP

(57) ABSTRACT

A container blank includes a front panel, a first-end panel, a back panel, a second-end panel, a plurality of first-side flaps, a plurality of second-side flaps, and a door. Each of the plurality of first-side flaps and each of the plurality of second-side flaps extend from a respective one of the front panel, the first-end panel, the back panel, and the second-end panel. The door includes a door-front portion formed in the front panel, a first-door-side portion formed in the first-side flap extending from the front panel and a second-door-side portion formed in the second-side flap extending from the front panel. The first-door-side portion and the second-door-side portion include a first crushed zone on an interior surface of the blank. The first-side flap extending from the front panel and the second-side flap extending from the front panel each include a second crushed zone on an exterior surface of the blank.

25 Claims, 14 Drawing Sheets

(56) References Cited

U.S. PATENT DOCUMENTS

| | | | | | |
|---|---|---|---|---|---|
| 1,616,707 | A | | 2/1927 | Tanner | |
| 1,743,502 | A | | 1/1930 | Tanner | |
| 1,903,461 | A | | 4/1933 | Keller | |
| 1,909,472 | A | | 5/1933 | Keppler | |
| 2,148,533 | A | | 2/1939 | Chapman | |
| 2,200,818 | A | | 5/1940 | Bergstein | |
| 2,233,488 | A | | 3/1941 | Powell | |
| 2,235,473 | A | | 3/1941 | Blinstrub | |
| 2,249,430 | A | | 7/1941 | Lambert | |
| 2,556,661 | A | | 6/1951 | Rendall et al. | |
| 2,556,707 | A | * | 6/1951 | Rendall et al. | 229/121 |
| 2,557,290 | A | | 6/1951 | Houldsworth | |
| 2,649,240 | A | | 8/1953 | Gilbert | |
| 2,684,792 | A | | 7/1954 | Kraus | |
| 2,746,665 | A | * | 5/1956 | Wiggins | 229/121 |
| 2,770,408 | A | | 11/1956 | Lindeberg | |
| 2,771,986 | A | | 11/1956 | Bekoff | |
| 2,803,390 | A | | 8/1957 | McKay | |
| 2,847,153 | A | | 8/1958 | Reynolds et al. | |
| 2,886,232 | A | | 5/1959 | Leone | |
| 2,907,512 | A | | 10/1959 | Leone | |
| 3,161,341 | A | | 12/1964 | Farquhar | |
| 3,207,380 | A | | 9/1965 | Hennessey | |
| 3,478,948 | A | | 11/1969 | Dornbush | |
| 3,528,597 | A | | 9/1970 | Zastrow | |
| 3,536,247 | A | * | 10/1970 | Gadiel | 229/122.1 |
| 3,568,877 | A | | 3/1971 | Mastrud, Jr. | |
| 3,568,911 | A | | 3/1971 | Bebout | |
| 3,593,908 | A | | 7/1971 | Desmond et al. | |
| 3,729,091 | A | | 4/1973 | Davis | |
| 3,944,128 | A | | 3/1976 | Hogan | |
| 4,186,866 | A | | 2/1980 | Zicko | |
| 4,283,000 | A | | 8/1981 | White | |
| 4,317,536 | A | | 3/1982 | Dickerson | |
| 4,602,735 | A | | 7/1986 | Aaron | |
| 4,752,029 | A | | 6/1988 | Buford | |
| 5,277,360 | A | | 1/1994 | DeMott | |
| 5,458,272 | A | | 10/1995 | Ward-Weber | |
| 5,555,982 | A | | 9/1996 | Kuhn et al. | |
| 5,626,283 | A | | 5/1997 | Mellon | |
| 5,657,872 | A | | 8/1997 | Leftwich et al. | |
| 5,950,914 | A | | 9/1999 | Dunton et al. | |
| 5,957,294 | A | | 9/1999 | Kanter | |
| 6,189,778 | B1 | | 2/2001 | Kanter | |
| 6,189,780 | B1 | | 2/2001 | Kanter | |
| 6,371,365 | B1 | | 4/2002 | Doucette et al. | |
| 6,932,265 | B2 | | 8/2005 | Sax et al. | |
| 6,951,300 | B2 | * | 10/2005 | Caille et al. | 229/121 |
| 6,997,317 | B2 | * | 2/2006 | Catelli | 206/438 |
| 7,066,380 | B2 | | 6/2006 | Blake | |
| 7,080,736 | B2 | | 7/2006 | Jackson et al. | |
| 7,147,129 | B1 | * | 12/2006 | Menefield | 221/283 |
| 7,204,406 | B2 | | 4/2007 | Bone | |
| 7,703,665 | B2 | * | 4/2010 | McGowan | 229/122.1 |
| 7,992,716 | B2 | | 8/2011 | Jackson | |
| 8,413,879 | B2 | | 4/2013 | Bevier | |
| 2003/0098344 | A1 | | 5/2003 | Blake | |
| 2003/0146130 | A1 | | 8/2003 | Kanter et al. | |
| 2003/0226783 | A1 | | 12/2003 | Jackson et al. | |
| 2003/0226879 | A1 | * | 12/2003 | Auclair et al. | 229/120.011 |
| 2005/0263434 | A1 | | 12/2005 | Tibbels | |
| 2006/0060643 | A1 | | 3/2006 | Sheffer | |
| 2006/0071058 | A1 | * | 4/2006 | Spivey, Sr. | 229/122 |
| 2007/0142798 | A1 | | 6/2007 | Goodlander et al. | |
| 2007/0142806 | A1 | | 6/2007 | Roe et al. | |
| 2007/0257096 | A1 | | 11/2007 | Coltri-Johnson | |
| 2008/0245850 | A1 | | 10/2008 | Spivey | |
| 2013/0186804 | A1 | | 7/2013 | Miller | |
| 2013/0206828 | A1 | | 8/2013 | Schomisch | |
| 2013/0313158 | A1 | * | 11/2013 | Nowak | 206/759 |
| 2014/0069930 | A1 | * | 3/2014 | Oakes | 220/525 |

OTHER PUBLICATIONS

PCT Written Opinion for International Application No. PCT/US2014/049952 dated Nov. 5, 2014 (4 pages).

* cited by examiner

DISPLAYABLE SHIPPING CONTAINER

CROSS-REFERENCE TO RELATED APPLICATIONS

This application claims priority to U.S. Provisional Application No. 61/863,070, filed on Aug. 7, 2013, which is hereby incorporated by reference in its entirety.

FIELD OF THE INVENTION

The present invention relates generally to containers. In particular, the present invention relates to displayable shipping containers having a door for controlling access to contents within the containers.

BACKGROUND

In shipping and displaying products, particularly in a retail setting, it is desirable to have a container which is easy to pack, sturdy and fully enclosed for protection of contents during storage and shipping, and also suitable for display at a retail site. For example, it is beneficial to have a container which allows a customer at a retail site to easily reach into the container and remove products for purchase. Of course, the access opening through which a consumer can access the products must also be closed during shipment and storage to prevent spilling of the product out of the container. This has resulted in the development of a variety of containers which are configured to be convertible from a shipping configuration to a display configuration, which permits the converted container to be placed directly upon a shelf, or floor display, without having to remove the individual product items from the container. One approach is to provide the container with removable portions that, when removed, create apertures through which customers may then help themselves to the products within the converted container. An alternative approach is to provide the container with a door that can be opened to provide access to the products within the container.

Such convertible containers represent a challenge in that they must be readily convertible into a form presentable to customers, while at the same time maintaining certain shipping performance characteristics, suitable for the shipment of non-self-supporting or even fragile products. Prior attempts at providing a displayable shipping container may suffer from a number of disadvantages. For example, prior displayable shipping containers often are lacking in the necessary shipping performance characteristics. Other displayable shipping containers are labor intensive to assemble or require expensive customization of automated equipment for assembly. And still other containers require excessive materials (e.g., doors formed from two panels such that the door has the thickness of two panels) or, in some cases, extraneous components (e.g., a tie or a wrap) to secure the container.

SUMMARY

According to aspects of the present disclosure, a displayable shipping container includes a bottom, a top, a front panel, a first side, a back panel, and a second side bridging the top and the bottom. The container further includes a door defined by a perforation extending across the front panel between the first side and the second side. The container further includes a door defined by a perforation extending across the front panel between the first side and the second side. The door is hingedly coupled to the bottom so as to be moveable between an open position and a closed position. The door includes a fold line dividing the door into a main portion and an support portion, which is configured to provide stiffening during movement of the door from the closed position to the open position. The container also includes a first door-side portion and a second door-side portion located on opposite sides of the door. The first door-side portion and the second door-side portion extend inwardly from front panel towards the back panel. The first door-side portion and the second door-side portion are configured to engage an interior surface of the front panel to stop movement of the door in the open position. The first side and the second side are formed from a plurality of side flaps. The first door-side portion and the second door-side portion are crushed on an exterior surface, and a flap forming the first side and a flap forming the second side are crushed on an interior surface so as to facilitate smooth opening of the door.

According to additional aspects of the present disclosure, a blank for a container includes a front panel, a first end panel extending from the front panel, a back panel extending from the first end panel, a second end panel extending from the back panel, a plurality first side flaps, a plurality of second side flaps, and a door. Each of the plurality of first side flaps extend from a respective one of the front panel, the first end panel, the back panel, and the second end panel. Each of the plurality of second side flaps extend from the respective one of the front panel, the first end panel, the back panel, and the second end panel. The door includes a door-front portion formed in the front panel, a first door-side portion formed in the first side flap extending from the front panel and a second door-side portion formed in the second side flap extending from the front panel. The first door-side portion and the second door-side portion include a first crushed zone on an interior surface of the blank. The first side flap extending from the front panel and the second side flap extending from the front panel each include a second crushed zone on an exterior surface of the blank.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
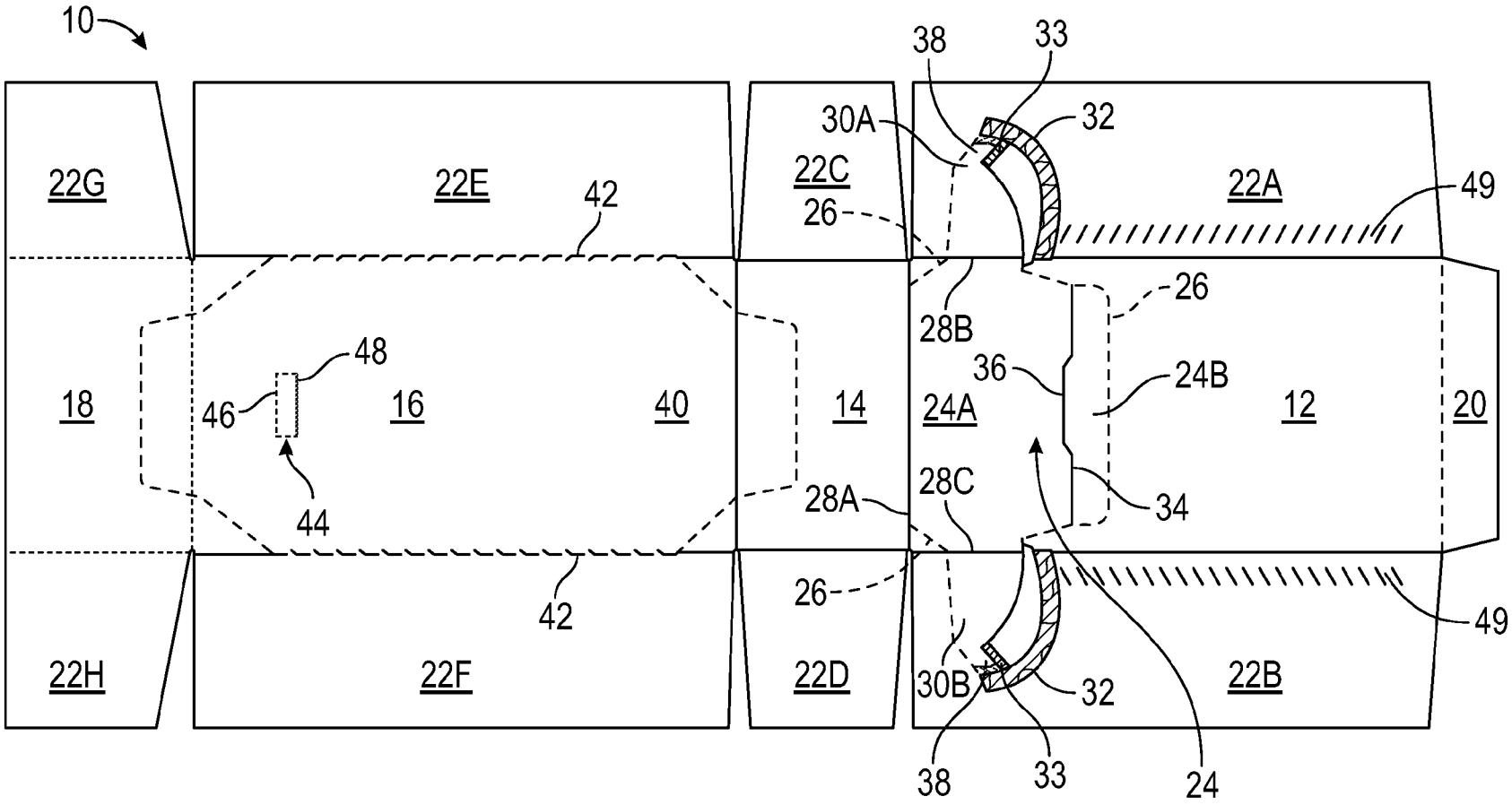
FIG. 1 is a top plan view of a blank for forming a container according some aspects of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1 illustrates a top plan view of a blank 10 for a container 100 according to aspects of the present disclosure. The blank 10 includes a front panel 12, a bottom panel 14, a back panel 16, and a top panel 18. The adjacent panels 12, 14, 16, 18 are connected with one another by substantially parallel fold lines. The blank 10 also includes an attachment flap 20. In the example illustrated in FIG. 1, the attachment flap 20 is connected to the front panel 12 by a fold line and is configured to be attached to the top panel 18, as described in further detail below. It should be understood that, according to alternative aspects, the attachment flap 20 can be connected to the bottom panel 14, the back panel 16, or the top panel 18 instead.

The blank 10 further includes a plurality of side flaps 22*a*-22*h* hingedly connected to the front panel 12, the bottom panel 14, the back panel 16, and the top panel 18. More particularly, a first major side flap 22*a* and a second major side flap 22*b* are connected to opposing sides of the front panel 12, a first minor side flap 22*c* and a second minor side flap 22*d* are connected to opposing sides of the bottom panel 14, a third major side flap 22*e* and a fourth major side flap 22*f* are connected to opposing sides of the back panel 16, and a third minor side flap 22*g* and a fourth minor side flap 22*h* are connected to opposing sides of the top panel 18, respectively, by fold lines.

The front panel 12 includes a door-front portion 24. The door-front portion 24 is defined by a plurality of perforation lines 26 and a plurality of fold lines 28*a*-28*c*. The perforation lines 26 are configured to permit the door-front portion 24 to be separable from the remainder of the front panel 12. The door-front portion 24 is connected to the bottom panel 14 at the fold line 28*a*, which connects the front panel 12 and the bottom panel 14. As such, the door-front portion 24 is configured to be hingedly moveable about the fold line 28*a*, as described in further detail below.

The door-front portion 24 includes a fold line 34 extending in a direction from the first major side panel 22*a* to the second major side panel 22*b*. The fold line 34 divides the door-front portion 24 into a main portion 24*a* and a support portion 24*b*. The door-front portion 24 further includes a slit 36.

The door-front portion 24 is further connected to a first door-side portion 30*a* of the first major side flap 22*a* by the fold line 28*b* and the second door-side portion 30*b* of the second major side flap 22*b* by the fold line 28*c*. The first major side flap 22*a* and the second major side flap 22*b* each include a crush zone 32 respectively separated from the first door-side portion 30*a* and the second door-side portion 30*b* by an aperture. The interior surface of the first major side flap 22*a* and the second major side flap 22*b* are crushed in the crush zones 32. The first door-side portion 30*a* and the second door-side portion 30*b* are each crushed in a crush zone 33 on an exterior surface thereof. The advantages associated with these crushed zones 32, 33 are described in greater detail below. Additionally, the first door-side portion 30*a* and the second door-side portion 30*b* each include a stop member 38, as described further below.

The blank 10 further includes a tear-away portion 40 defined by a plurality of perforation lines 42. In the illustrated embodiment, the tear-away portion 40 is formed in the bottom panel 14, the back panel 16, and the top panel 18. The tear-away portion 40 includes a hook-catch portion 44 configured to allow the assembled container to be suspended from a hook for display (see FIG. 8). According to some aspects, the hook-catch portion 44 can be defined by a perforation line 46 and a fold line 48. Alternatively, the fold line 48 can be omitted so that the hook-catch portion 44 is entirely defined by a perforation line 46 that forms a pop-out portion (not shown).

The assembly of the blank 10 to form the displayable shipping container 100 (see FIG. 2) will now be described. First, the attachment flap 20 is attached to the top panel 18 by, for example, a suitable adhesive(s). Next, the minor side flaps 22*c*, 22*d*, 22*g*, 22*h* are folded inward (i.e., toward an interior space formed by the panels 12, 14, 16, 18). Then, the first major side flap 22*a* and the second major side flap 22*b*, followed by the third major side flap 22*e* and the fourth major side flap 22*f* are folded inward. The first major side flap 22*a* is sealed to the third major side flap 22*e* (e.g., by tape, staples, adhesives, combinations thereof, and/or the like) and the second major side flap 22*b* is sealed to the fourth major side flap 22*f*, for example, at respective attachment areas 49. The attachment areas 49 are configured to not extend over the door-side portions 30*a*, 30*b* so as to not to inhibit movement of the door-side portions 30*a*, 30*b*. It should be appreciated that the side flaps 22*a*-22*h* can be folded as described above such that one side of the container 100 is formed before the other side of the container 100 is formed. In such instances, the product can be loaded into the container 100 before the second side is formed. Alternatively, both sides of the container 100 can be formed simultaneously.

Advantageously, the assembly of the container 100 can be achieved with assistance of a case erector that requires no special customization. Indeed, standard case erector equipment is configured to erect containers by attaching an attachment flap to a main panel, then folding in minor side flaps, and then folding in each major side flap. It is believed that prior containers having a door cannot achieve this advantage. Rather, it is believed that prior containers require special or customized equipment to fold additional side flaps or more than four panels in order to erect a container having a bin door. As a result, the container 100 of the present disclosure can be more efficiently manufactured at a reduced cost. It should be understood, however, that according to alternative aspects, the container 100 can be manually erected, in whole or in part, without the assistance of a case erector machine. Additionally, it should be understood that, according to additional and/or alternative aspects, the attachment flap 20 can be pre-glued to the top panel 18 prior to the blank 10 being placed into the case erector equipment.

Figure 2:
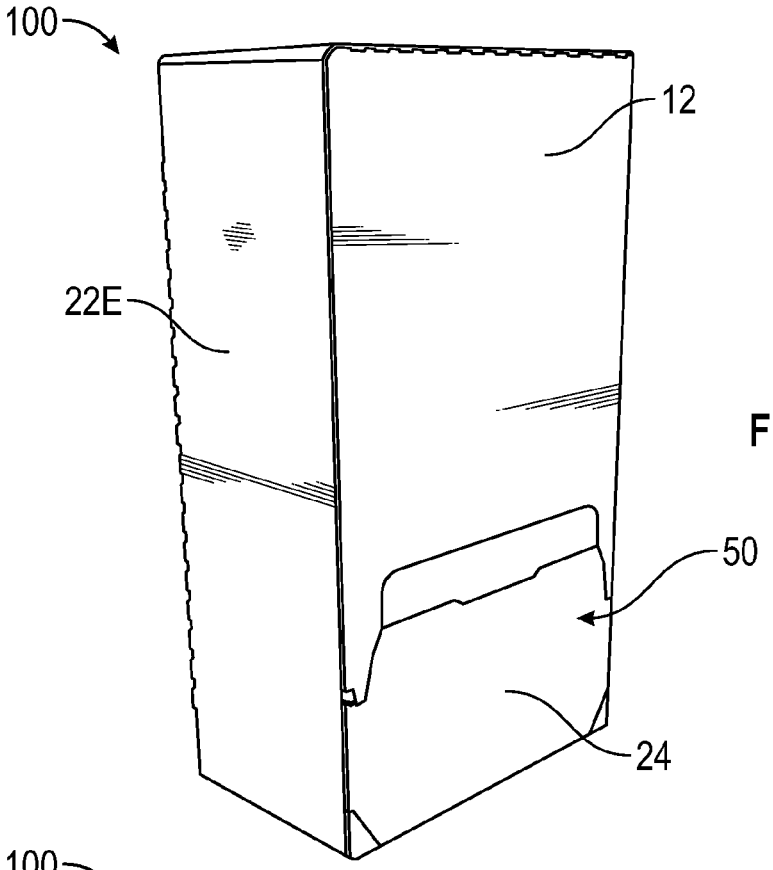
FIG. 2 is a perspective view of the container formed from the blank of FIG. 1 in a shipping configuration.

FIG. 2 shows the container 100 in a shipping configuration. In the shipping configuration, the container 100 provides a closed enclosure that prevents the loss of product and product damage during shipping. The front panel 12, the bottom panel 14, the back panel 16, the top panel 18, and the plurality of side flaps 22*a*-22*h* define an interior space of the container 100 in which product can be provided.

Figure 3:
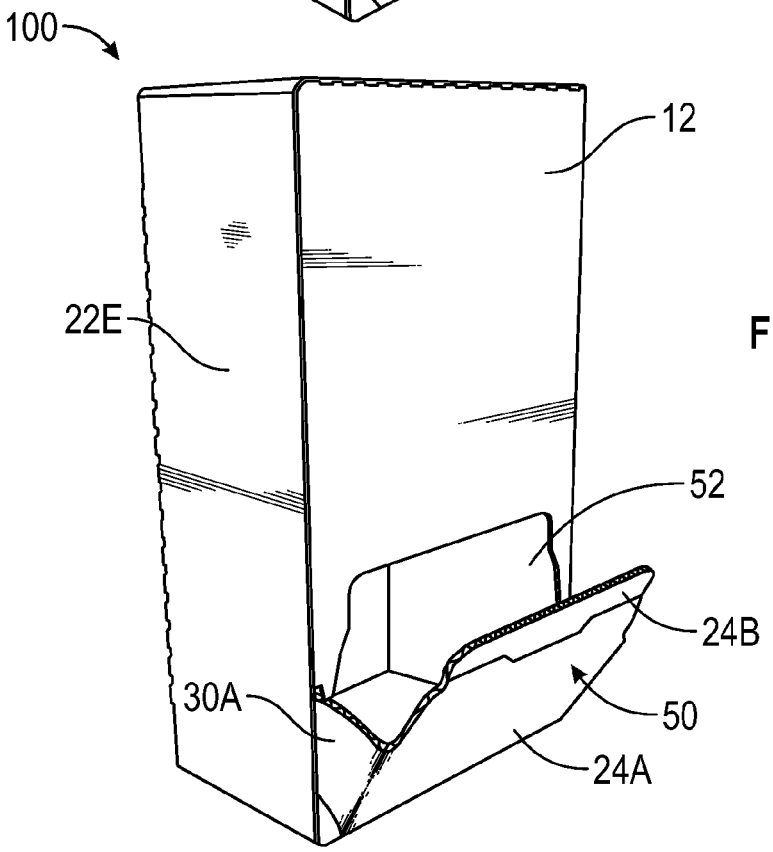
FIG. 3 is a perspective view of the container formed from the blank of FIG. 1 in a first display configuration.

After shipping the container 100 to a retail site, the container 100 can be converted from the shipping configuration (FIG. 2) to one or more display configurations. FIG. 3 shows the container 100 in a first display configuration. To convert the container 100 from the shipping configuration to the first display configuration, a door 50 moved from a closed position as shown in FIG. 2 to an open position as shown in FIG. 3. The door 50 is formed by the door-front portion 24 of the front panel 12, the first door-side portion 30*a* of the first major side flap 22*a*, and the second door-side portion 30*b* of the second major side flap 22*b*.

In particular, to open the door 50, the perforation line 26 is broken and the door 50 is rotated about the fold line 28*a* to move the door 50 from the closed position to the open position. Advantageously, the support portion 24*b* of the door 50 can be utilized to facilitate the opening of the door 50. By applying pressure to the support portion 24*b*, the support portion 24*b* can be separated from the front panel 12 along the perforation line 26. The support portion 24*b* can then be pulled outwardly to detach the main portion 24*a* of the door from the front panel 12. The fold line 34 separating the main portion 24*a* from the support portion 24*b* assists in providing a variety of angles for the outward pulling of the support portion 24*b*, which minimizes the stress placed on the door 50 as it is opened.

Additionally and/or alternatively, the slit 36 can be utilized to facilitate the opening of the door 50. By applying pressure to the main portion 24*a* of the door-front panel 24, a user can access the interior surface of the support portion 24*b*. An outward force can then be applied to the interior surface of the support portion 24*b* to break the perforation line 26 and detach the door 50 from the front panel 12. With the perforation line 26 broken, the door 50 can then be freely moved to the open door position as shown in FIG. 3.

While the slit 36 is provided in the illustrated container 100 to facilitate the opening of the door 50, it is contemplated that according to alternative aspects the slit 36 can be omitted or another feature can be provided to facilitate the opening of the door 50 (e.g., an aperture). However, providing the slit 36 instead of an aperture advantageously allows the container 100 to be more fully closed in the shipping configuration and, thus, better protects products within the container 100 during shipping.

Additionally, while the illustrated container 100 includes a door 50 having a main portion 24*a* and a support portion 24*b*, it is contemplated that according to alternative aspects the present disclosure, the door 50 can omit the support portion 24*b*. However, the support portion 24*b* can be advantageous because, as described above, the support portion 24*b* provides a stiffened surface against which a force can be applied to facilitate the opening of the door 50. This stiffened surface provided by the support portion 24*b* substantially inhibits unintended and undesirable ripping or tearing of the door-front panel 24 when attempting to open the door 50.

As shown in FIG. 3, with the container 100 in the first display configuration, the container 100 includes a window opening 52 in the front panel 12 for providing access to the interior space of the container 100 and any product stored therein. The door 50 thus controls access to the window opening 52 and the interior space within the container 100. That is, the door 50 restricts access to the window opening 52 in the closed position and allows access to the window opening 52 in the open position.

Figure 4:
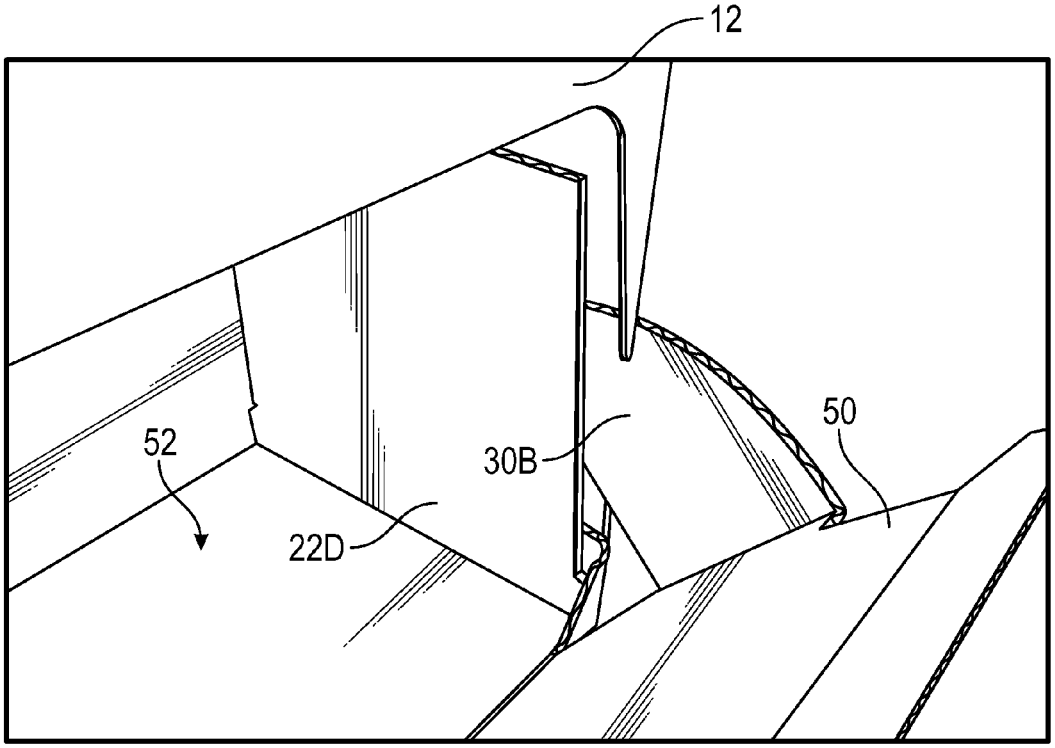
FIG. 4 is a partial perspective view of an interior portion of the container shown in FIG. 3.

The container 100 includes a number of features configured to inhibit unintended egress of product from within the container 100. For example, the door-side portions 30*a*, 30*b* can be configured to limit the outward extension of the door 50 and also provide a side barrier to retain product. In the shipping configuration, the first door-side portion 30*a* is located between the first minor side flap 22*c* and the third major side flap 22*e*, and the second door-side portion 30*b* is located between the second minor side flap 22*d* and the fourth major side flap 22*f*. This mitigates the problem of product within the container 100 interfering with the movement of the door-side portions 30*a*, 30*b* as the door 50 is moved from the closed position to the open position. To illustrate, FIG. 4 shows the door 50 being moved from the closed position to the open position such that the door-side portions 30*a*, 30*b* slide within the protected space between the respective side flaps 22*c*, 22*e* and 22*d*, 22*f*.

The container 100 is configured such that, in the shipping configuration, the first door-side portion 30*a* and the second door-side portion 30*b* are substantially coplanar with the first major side flap 22*a* and the second major side flap 22*b*, respectively. Advantageously, by configuring the container 100 in this way, the sides of the container 100 can have a minimal number of flaps (i.e., the sides of the container 100 can be only three flaps thick) while providing the space for protecting movement of the door-side portions 30*a*, 30*b* (i.e., the space between the minor flaps 22*c*, 22*d* and the major flaps 22*e*, 22*f*). This is possible because the door-side portions 30*a*, 30*b* are crushed on the exterior surface thereof in the crush zones 33 and the respective major side flaps 22*a*, 22*b* are crushed on the interior surface thereof in the crush zones 32, as described above with respect to FIG. 1. These opposing crushed zones 32, 33 cause the first door-side portion 30*a* and the second door-side portion 30*b* to move inwards (i.e., away from the first major side flap 22*a* and the second major side flap 22*b*) as the door 50 is moved from the closed position to the open position. Otherwise, the first door-side portion 30*a* and the second door-side portion 30*b* might engage and become stuck on the first major side flap 22*a* and the second major side flap 22*b*, inhibiting further movement of the door 50 to the open position.

Figure 5:
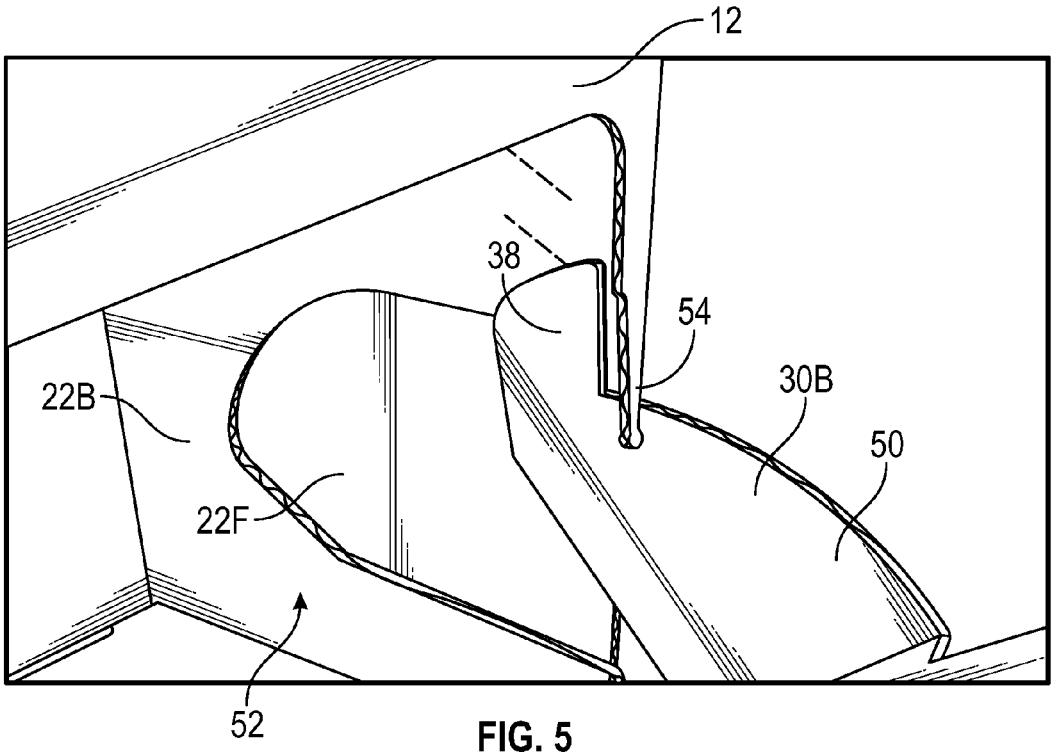
FIG. 5 is a partial perspective view of the container shown in FIG. 3 with a door in an open position.

As described above with respect to FIG. 1, the door-side portions 30*a*, 30*b* each include a stop member 38 that is configured to limit further opening of the door 50 past the open position. In particular, the stop members 38 engage an interior surface of the front panel 12 when the door 50 is fully moved to its open position. By limiting the outward movement of the door 50, the product within the container 100 is substantially inhibited from spilling out. FIG. 5 illustrates (with the second minor side flap 22*d* omitted for ease of explanation) the stop member 38 of the second door-side portion 30*b* engaging the interior surface of the front panel 12, thus limiting further outward movement of the door 50 past the open position. Also shown in FIG. 5, the front panel 12 can include a slot 54 in which the second door-side portion 30*b* can be located when the door 50 is in the open position to more securely hold the stop member 38 in engagement with the interior surface of the front panel 12. A corresponding slot 54 can also be provided on the other side of the window opening 52 to assist in retaining the stop member 38 of first door-side portion 30*a* in engagement with the interior surface of the front panel 12.

Figure 6A:
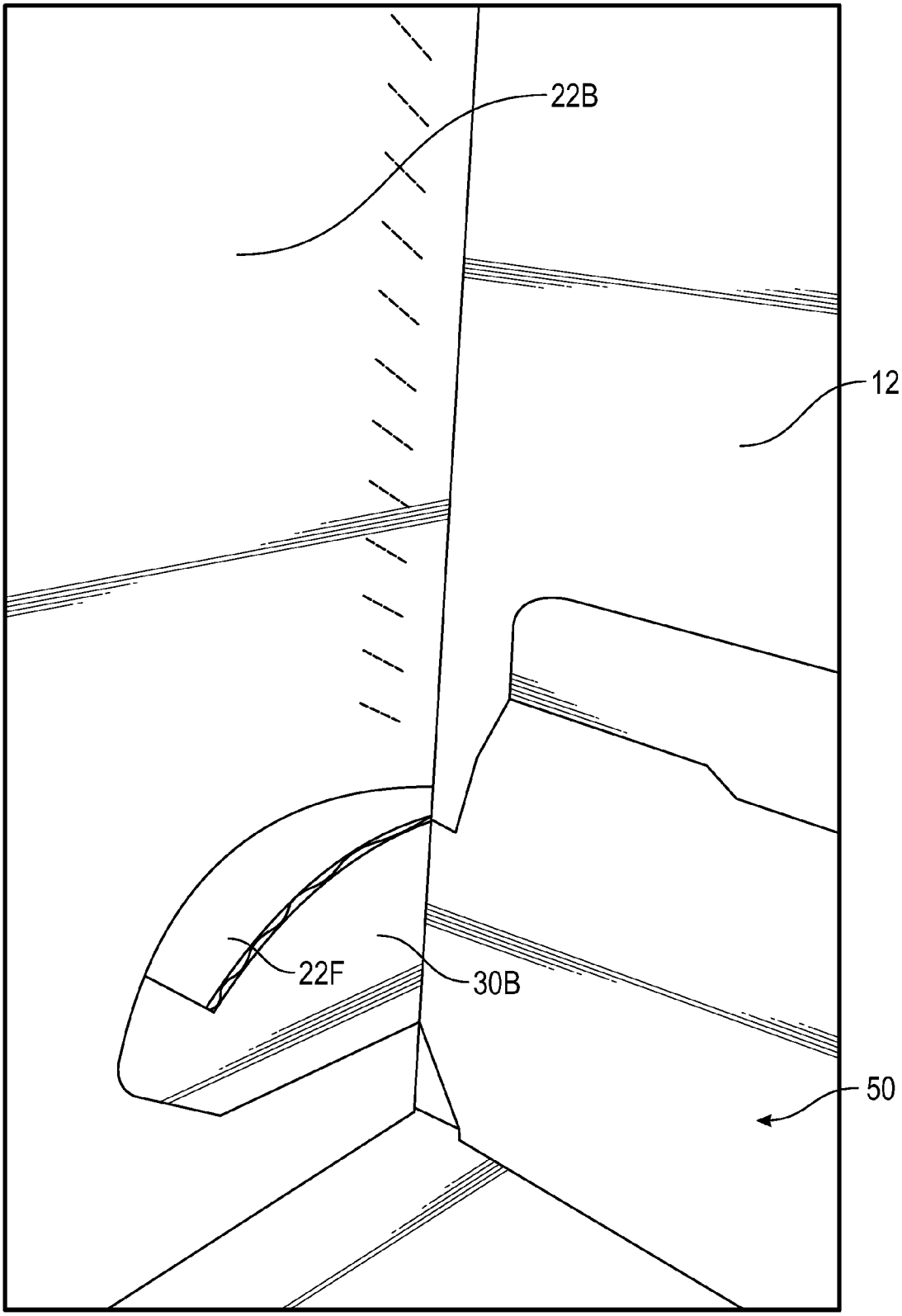
FIGS. 6A-6D are a sectional views of the container formed from the blanks of FIG. 1 as the container is being converted from a shipping configuration to a first display configuration.
Figure 6B:
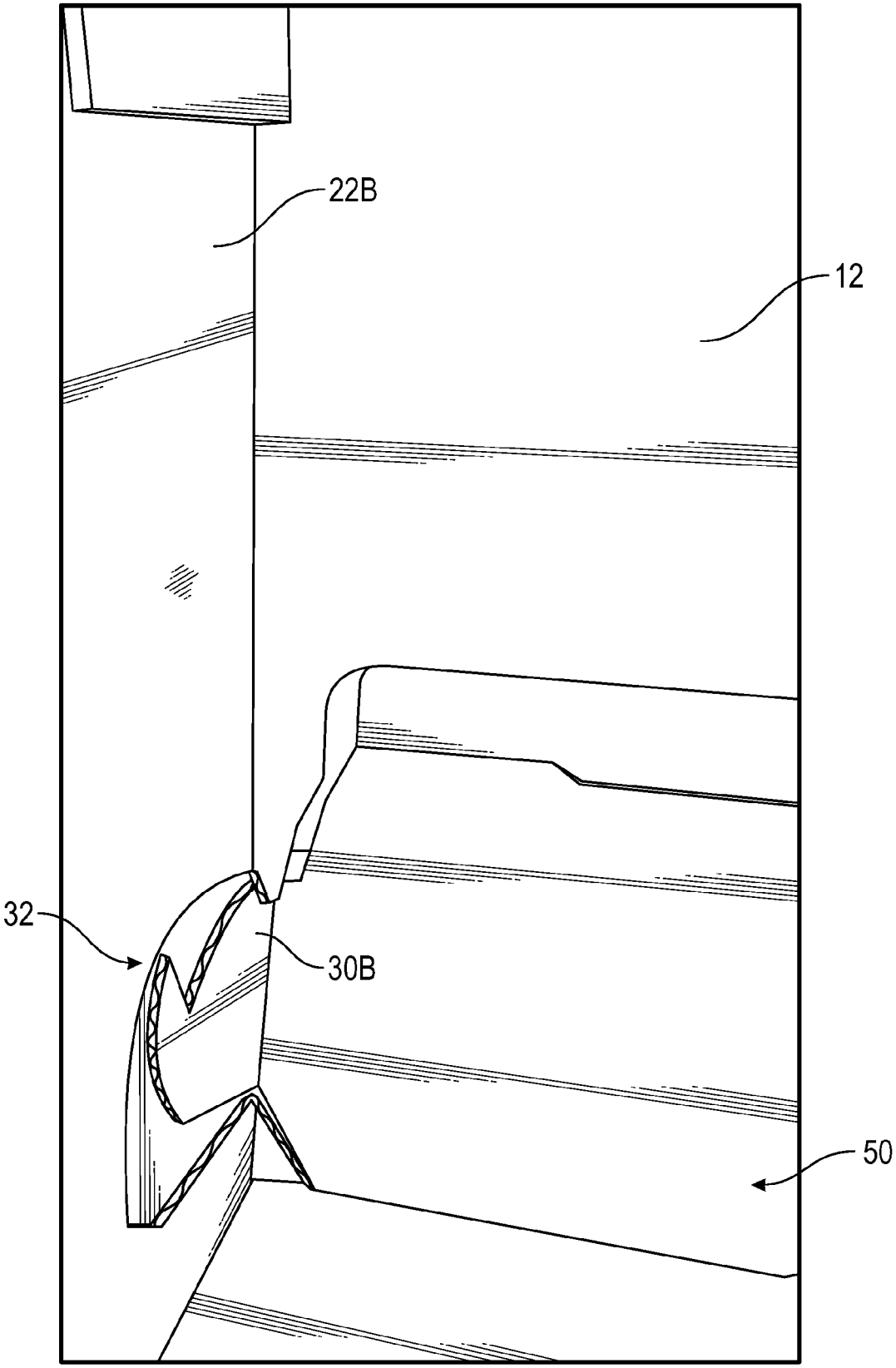
Figure 6C:
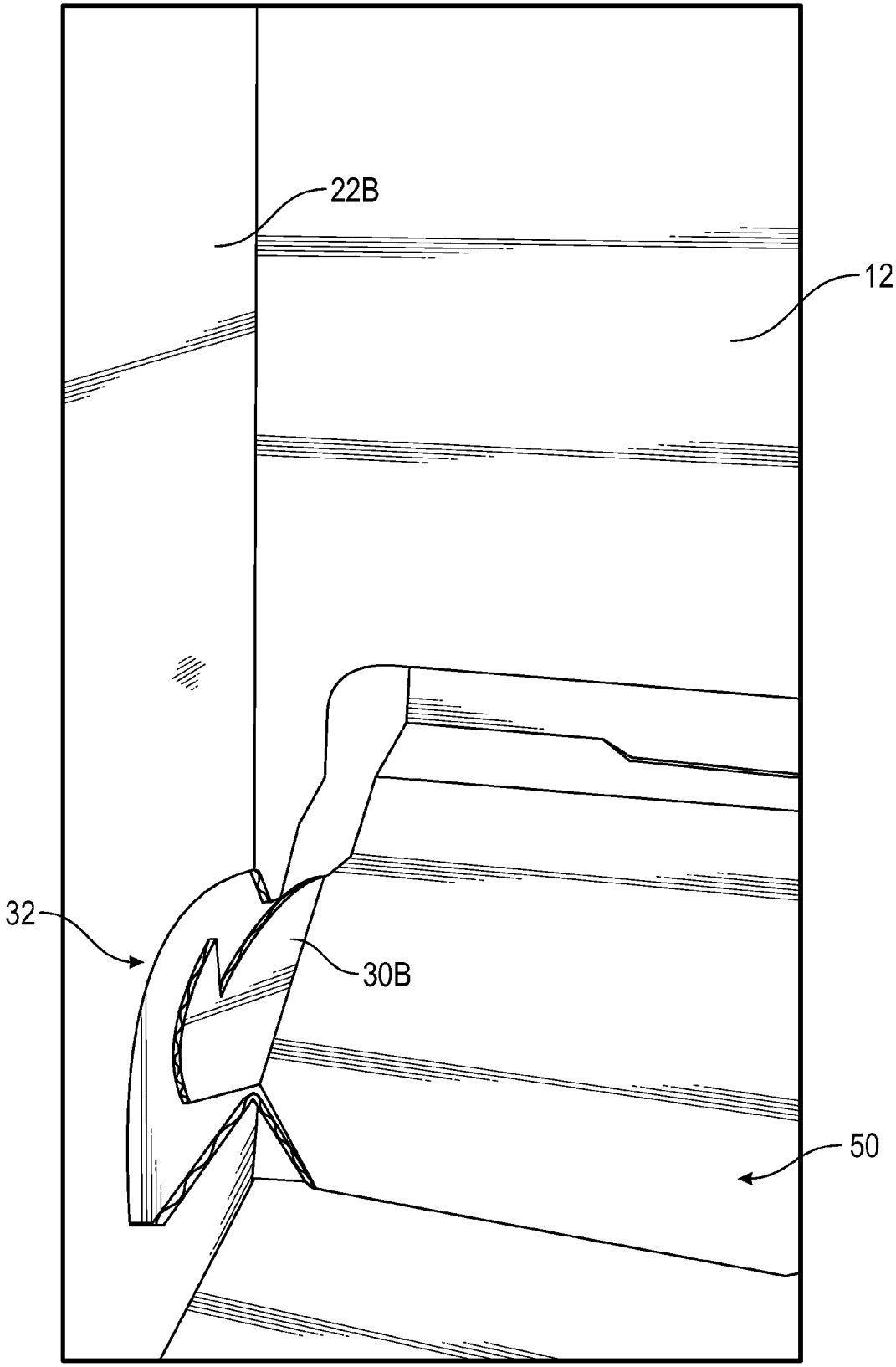
Figure 6D:
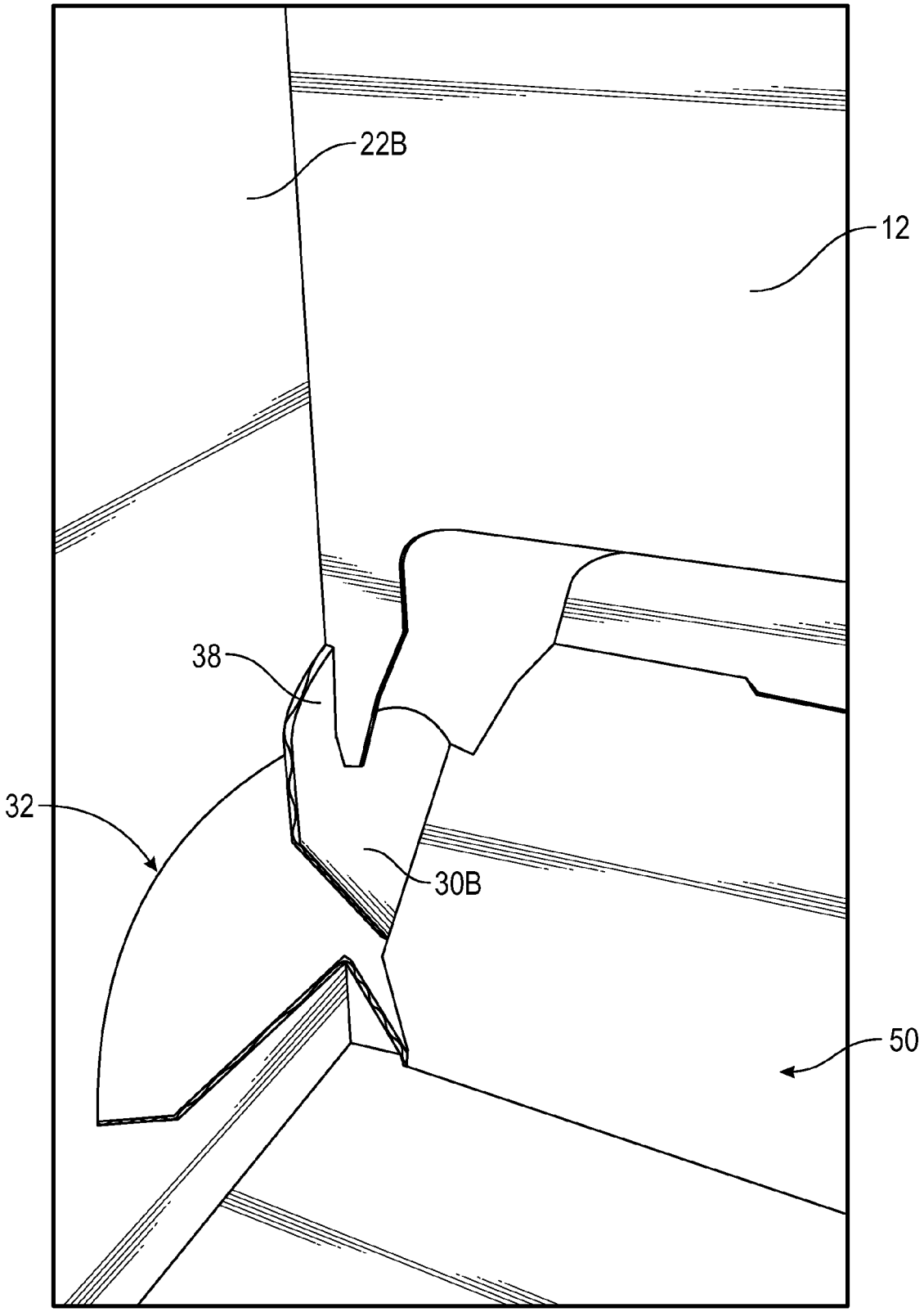

FIGS. 6A-6D further illustrate the movement of the door-side portions 30*a*, 30*b* within the protected space (with portions of the container 100 omitted for ease of explanation purposes) as the door 50 is moved from the closed position to the open position. FIG. 6A illustrates the second door-side portion 30*b* when the door 50 is in the closed position. As shown in FIG. 6A, the second door-side portion 30*b* is generally coplanar with the second major side flap 22*b*. FIG. 6B shows the second door-side portion 30*b* as the door 50 is moved an initial amount from the closed position towards the open position. As shown in FIG. 6B, the crushed zone 33 of the second door-side portion 30*b* has contacted the crush zone 32 on the second major side flap 22*b*, causing the second door-side portion 30*b* to move inwards. FIG. 6C illustrates the second door-side portion 30*b* as the door 50 is moved a further amount towards the open position. As shown in FIG. 6C, the second door-side portion 30*b* has moved even further inwards and way from the second major side flap 22*b* so as to be clear of the crush zone 32. Thus, although the second door-side portion 30*b* contacts the second major side flap 22*b* as the door 50 is opened, the crushing 32 on the interior surface of the second major side flap 22*b* and the crushing 33 on the exterior surface of the second door-side portion 30*b* cause the second door-side portion 30*b* to move inwards and clear of the second major side flap 22*b*. The door 50 is further opened until it reaches the open position as illustrated in FIG. 6D. Accordingly, the respective crushed areas 32, 33 on the door-side portions 30*a*, 30*b* and the major side flaps 22*a*, 22*b* facilitate the smooth movement of the door-side portions 30*a*, 30*b* (from a generally coplanar position to a non-coplanar position relative to the major side flaps 22*a*, 22*b*) within the protected space between the minor side flaps 22*c*, 22*d* and the major side flaps 22*a*, 22*b* as the door 50 is moved from the closed position to the open position.

Figure 7:
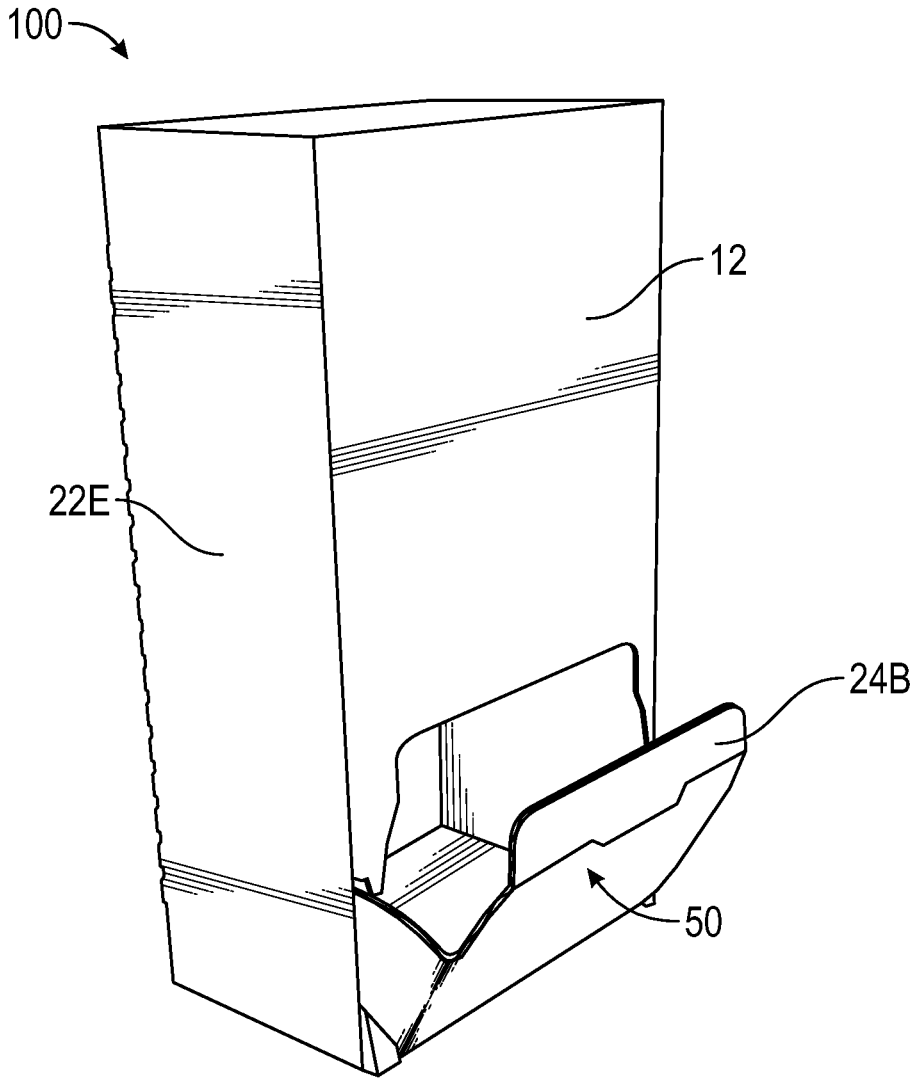
FIG. 7 is a perspective view of the container formed from the blank of FIG. 1 in the first display configuration.

FIG. 7 illustrates an additional feature that facilitates retention of product within the container 100. As shown in FIG. 7, the support portion 24*b* can be folded back towards the container 100 along the fold line 34 to maintain product within the container and prevent spillage therefrom. Advantageously, when the support portion 24*b* is utilized to initiate the conversion of the container 100 from the shipping configuration to the first display configuration (e.g., by pressing the support portion 24 inwards to separate the door 50 from the front panel 12 and then pulling outwardly on the support portion 24), the support portion 24*b* may be automatically oriented at an angle towards the container 100 relative to the main portion 24*a*, providing the retention functionality. Additionally, as the support portion 24*b* can be folded upwards along the fold line 34, the support portion 24*b* can optionally be provided with graphics for display.

Figure 8:
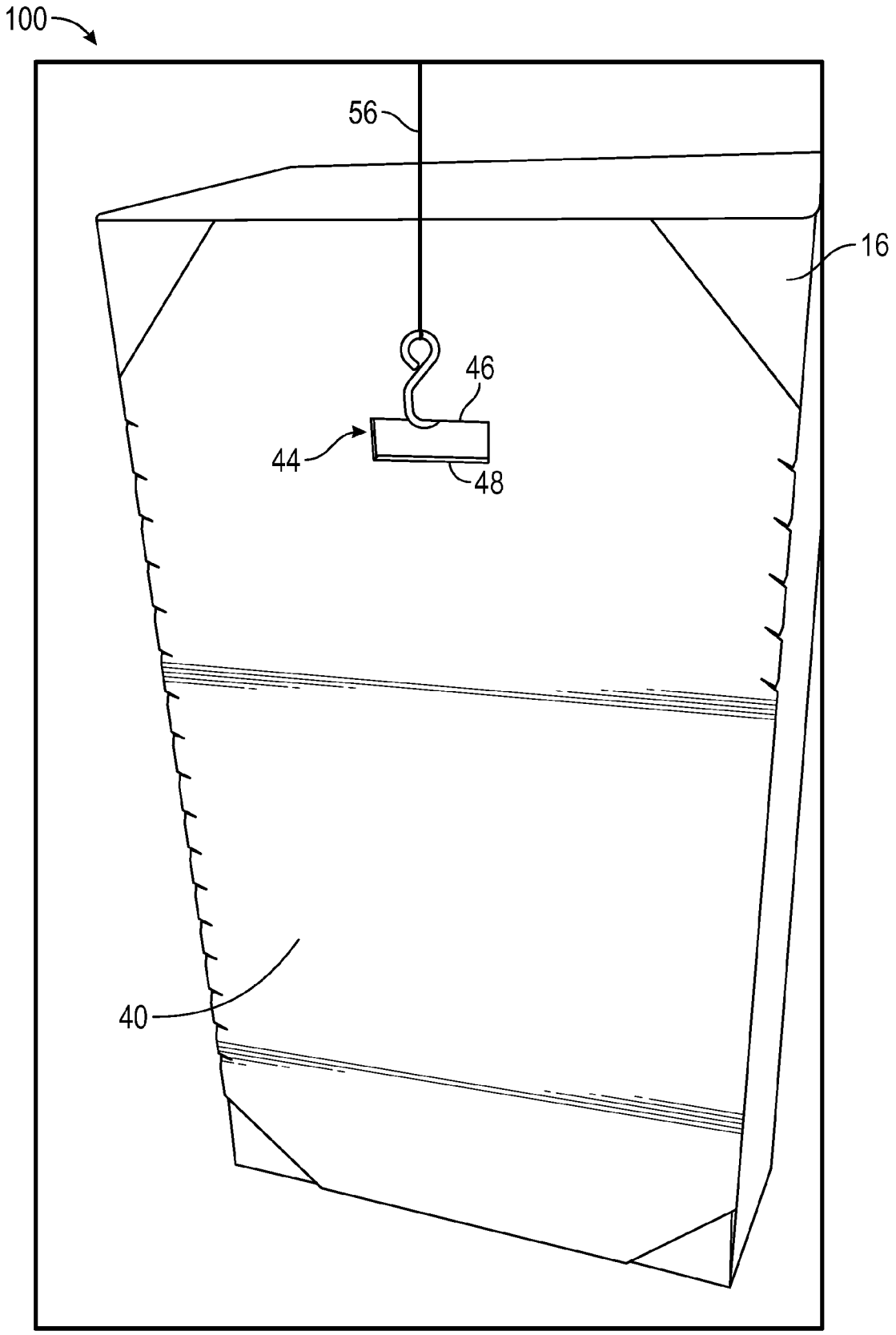
FIG. 8 is a back view of the container formed from the blank of FIG. 1 displayed on a hook according to aspects of the present disclosure.

According to some aspects, the container 100 in the first display configuration optionally can be hung on a hook 56 that engages the hook-catch portion 44 as shown in FIG. 8. To hang the container 100 on the hook 56, the perforation line 46 can be broken and the hook-catch portion 44 folded along the fold line 48. The hook 56 can then be inserted into a resulting hook opening 58.

Notably, the container 100 can achieve the above described functionalities of the first display configuration with only four main panels 12, 14, 16, 18. That is, unlike other containers that require a fifth panel to form a door (e.g., the door may be two panels thick), the container 100 can be achieved with only four main panels 12, 14, 16, 18 such that the door 50 has the thickness of only a single panel (i.e., the panel 12). Additionally, as described above, the container 100 of the present disclosure can achieve a protected space for the door-side portions 30*a*, 30*b* such that the sides of the container 100 have a thickness of only three flaps (e.g., the flaps 22*b*, 22*d*, 22*f* for the protected space in which the second door-side portion 30*b* moves). As a result, the container 100 of the present disclosure can be manufactured from less material, mitigating waste, and achieving considerable efficiencies and cost savings.

Figure 9:
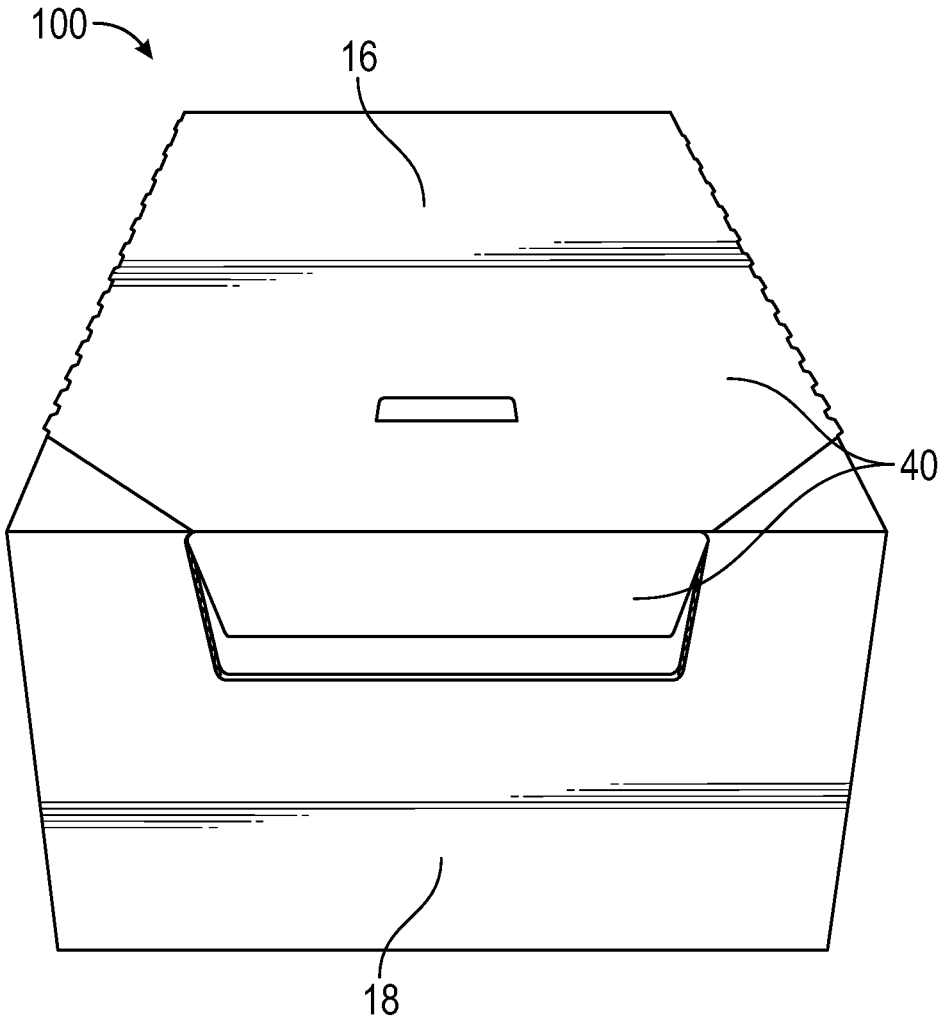
FIG. 9-13 are a top views of the container formed from the blanks of FIG. 1 as the container is being converted from a shipping configuration to a second display configuration.
Figure 10:
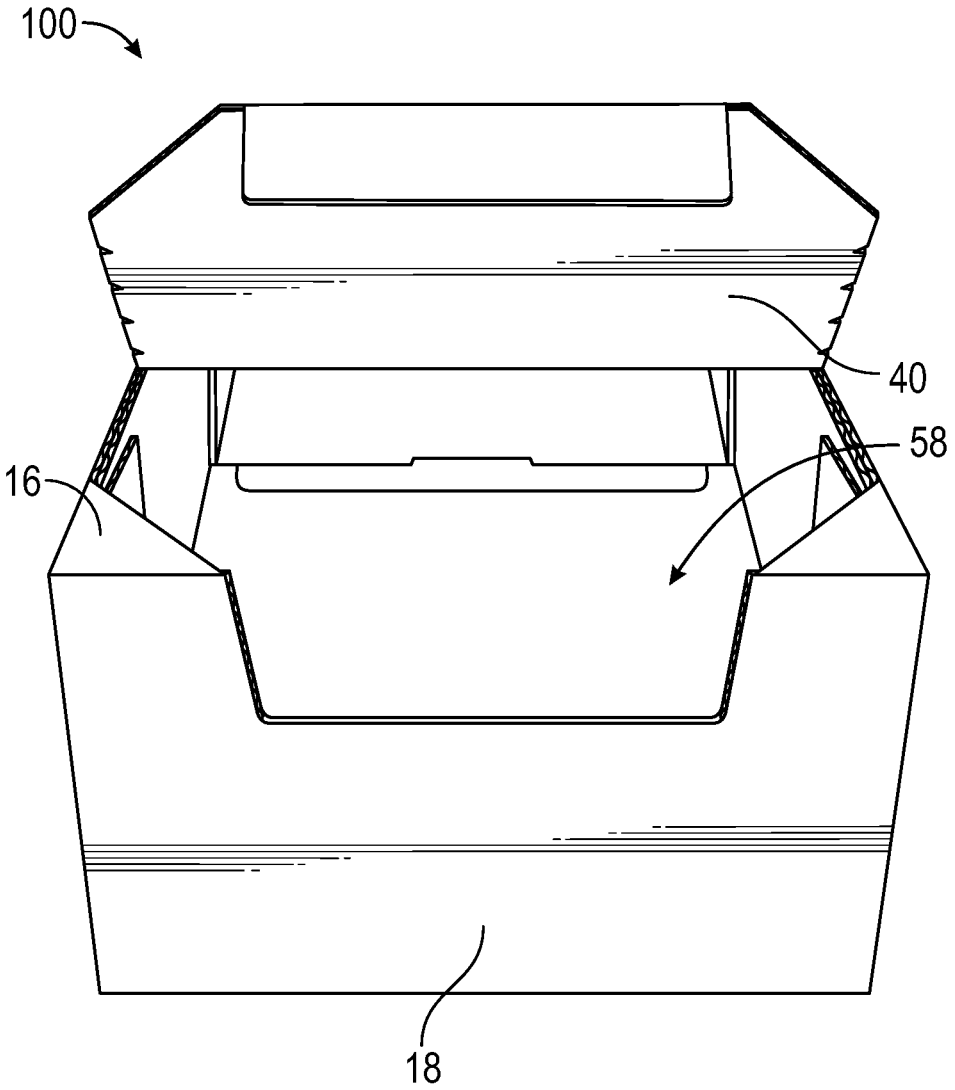
Figure 11:
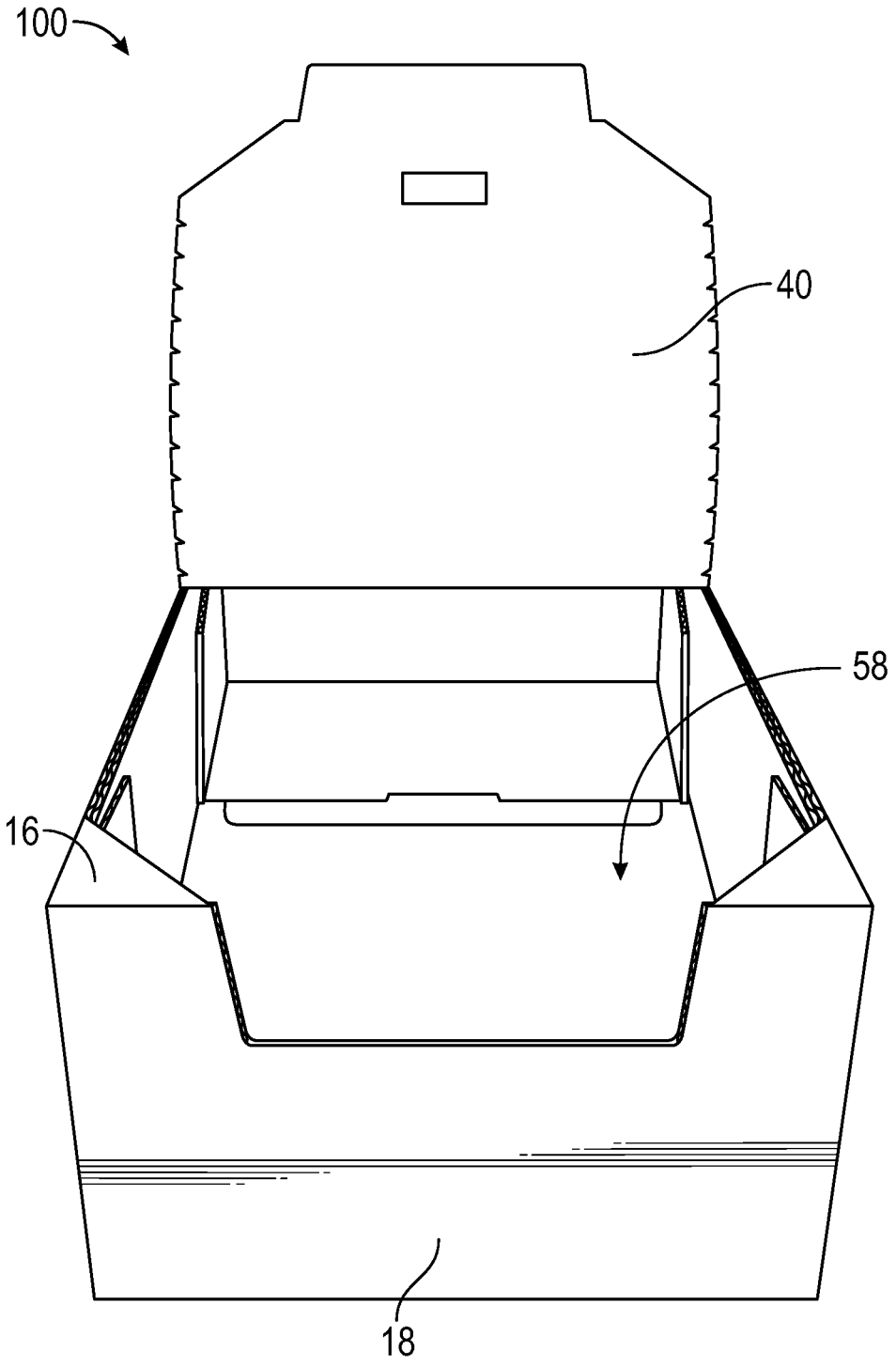
Figure 12:
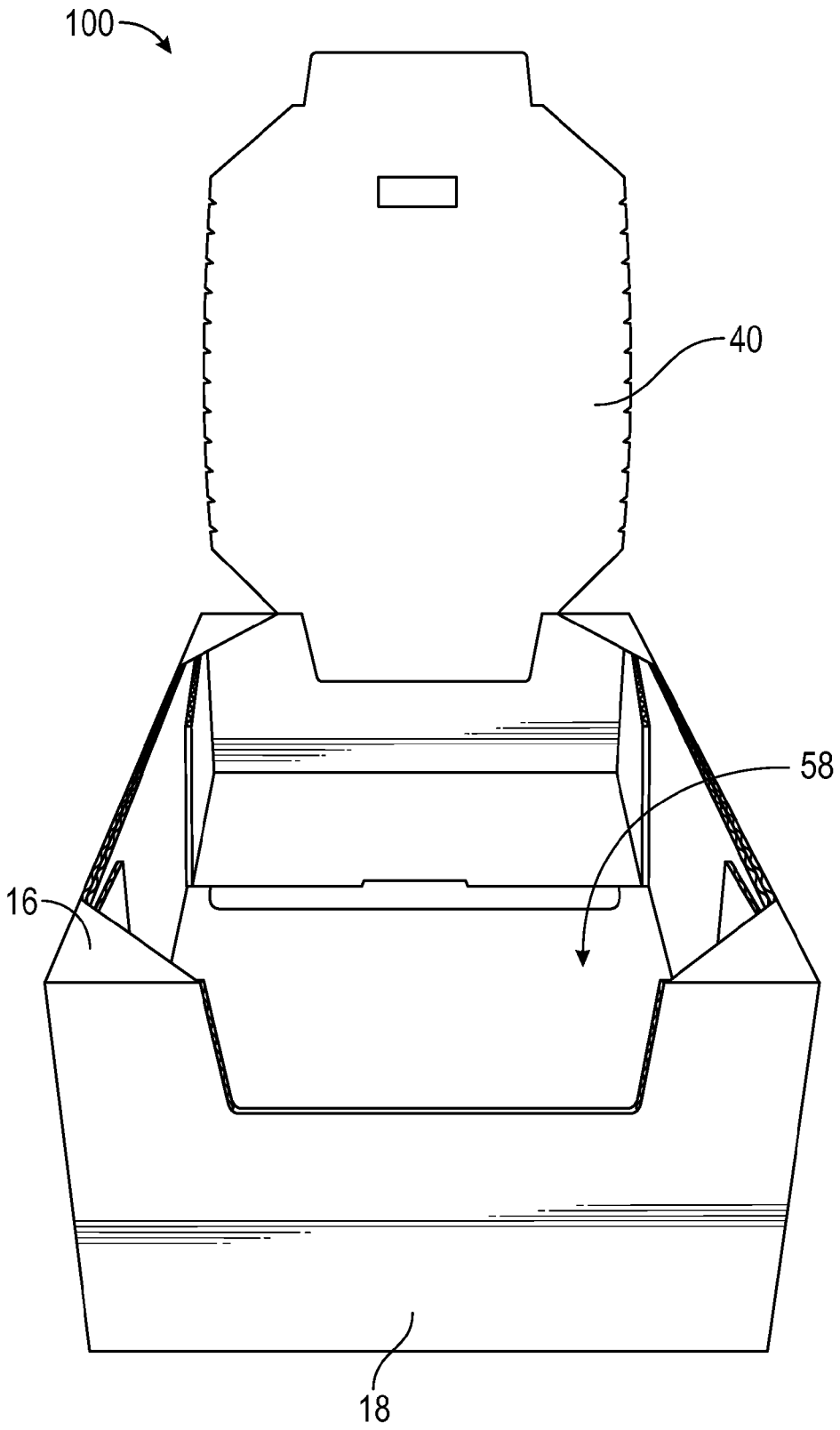
Figure 13:
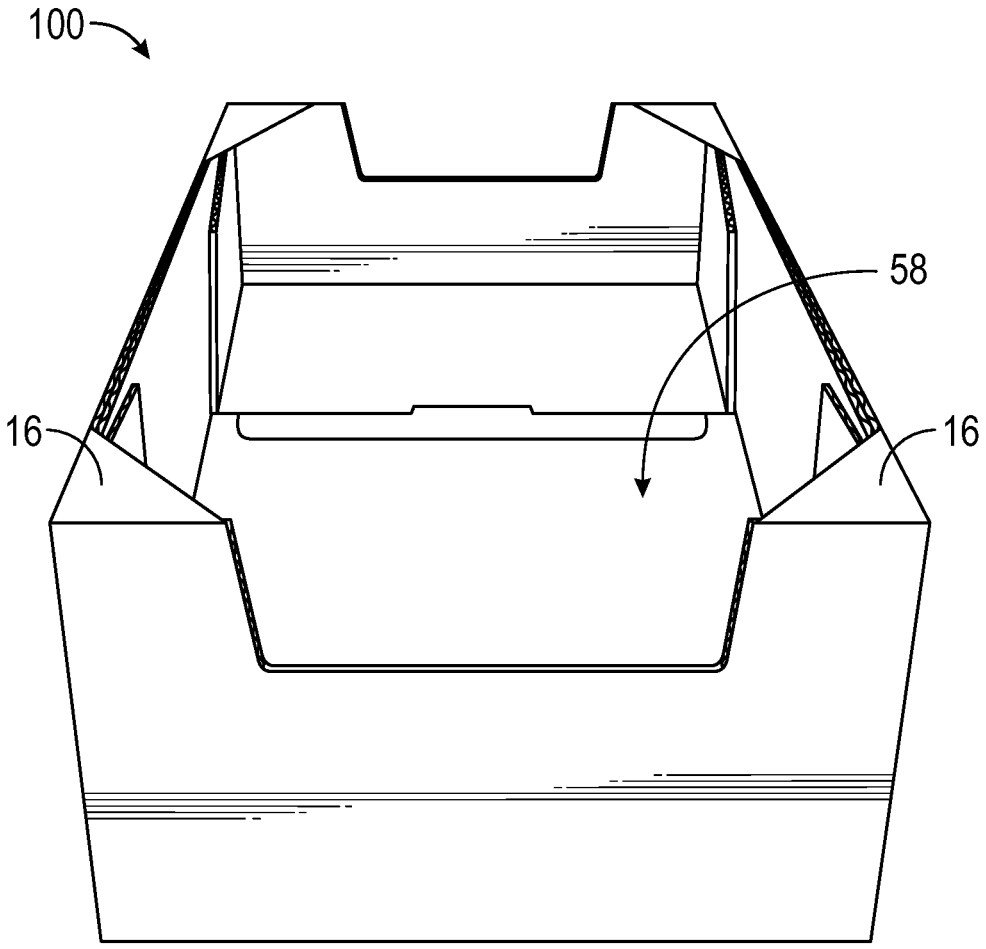

In addition or the alternative to the first display configuration of the container 100 illustrated in FIGS. 3 and 7 and described above, the container 100 can be converted to a second display configuration. FIGS. 9-13 illustrate the container 100 being converted from the shipping configuration (shown in FIG. 2) to the second display configuration. The following are exemplary steps for converting the container 100 from the shipping configuration to the second display configuration. As shown in FIG. 9, the tear-away portion 40 can be first separated from either the bottom panel 14 or the top panel 18. Then, as shown in FIG. 10, the tear-away portion 40 can be pulled upwardly relative to the back panel 16 to separate a portion of the tear-away portion 40 from the back panel 16. As shown in FIG. 10, when the tear-away portion 40 is separated from the back panel 16, a display opening 58 is formed. The display opening 58 allows access to products within the container 100. If so desired, the tear-away portion 40 can be further pulled to separate the tear-away portion 40 from the back panel 16 and, thus, increase the size of the display window 58 as shown in FIGS. 11-12. Optionally, the tear-away portion 40 can be entirely removed from the container 100 as shown in FIG. 13. As the size of the display opening 58 increases, greater access to the contents of the container 100 can be provided.

Additionally, as shown in FIG. 13, with the tear-away portion 40 entirely removed, a portion of the back panel 16 can remain on the container 100. This can advantageously allow multiple containers 100 to be stacked despite the removal of the tear-away portion 40 and also increase the stacking strength of the container 100 in the shipping configuration. Further, it is contemplated that the interior surface of the tear-away portion 40 can include graphics so that the graphics are displayed when the container 100 is in the second display configuration as shown, for example, in FIGS. 11-12.

The containers of the embodiments described herein are typically manufactured using corrugated paperboard, preferably with the corrugations running in a vertical direction for increased strength. As non-limiting examples, the container 100 is manufactured from C-flute, EB-flute, E-flute, F-flute, N-flute, or B-flute corrugated paperboard. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials.

While the containers of the embodiments described above include glue or adhesive for attaching various panels and flaps of the containers, it is contemplated that any other suitable method of joining or attaching panels and flaps may be utilized such as, for example, staples, tapes, a system of corresponding slits and tabs, combinations thereof, and/or the like.

While the present invention has been described with reference to one or more particular embodiments, those skilled in the art will recognize that many changes may be made thereto without departing from the spirit and scope of the present invention. For example, while the door 50 is illustrated and described as being hingedly connected to the bottom panel 16, it should be understood that the door 50 can be hinged about a fold line on the front panel 12 spaced away from the bottom panel 16. Additionally, for example, while the container 100 illustrated and described herein is configured to be converted to the first display configuration and the second display configuration, it should be understood that the container 100 can alternatively be configured to convert to only one of the first display configuration or the second display configuration. Each of the embodiments and obvious variations thereof is contemplated as falling within the spirit and scope of the claimed invention, which is set forth in the following claims.

What is claimed is:

1. A container comprising:

a bottom;

a top opposing the bottom;

a front panel, a first side, a back panel, and a second side bridging the top and the bottom;

a door defined by a perforation extending across the front panel between the first side and the second side, the door being moveable between an open position and a closed position, the door including a fold line dividing the door into a main portion and a support portion, the support portion being configured to provide stiffening during movement of the door from the closed position to the open position, the door having the same thickness as the front panel; and a first door-side portion and a second door-side portion located on opposite sides of the door, the first door-side portion and the second door-side portion extending inwardly from the front panel towards the back panel, the first door-side portion and the second door-side portion being configured to engage an interior surface of the front panel to stop movement of the door in the open position.

2. The container of claim 1, wherein the first side and the second side are each formed from a plurality of side flaps, the first door-side portion and the second door-side portion each being crushed on an exterior surface in a respective first crushed zone, one of the plurality of side flaps forming the first side and another of the plurality of side flaps forming the second side being crushed on a respective interior surface in a second crushed zone.

3. The container of claim 2, wherein the first crushed zones are configured to contact the second crushed zones when the door is moved from the closed position to the open position such that the first door-side portion and the second door-side portion are forced inwards when the door is moved from the closed position to the open position.

4. The container of claim 3, wherein the first door-side portion and the second door-side portion are each coplanar with respective ones of the plurality of side flaps crushed on the interior surface in the second crushed zone when the door is in the closed position.

5. The container of claim 3, wherein the front panel includes a first slot and a second slot configured to receive the first door-side portion and the second door-side portion, respectively, when the door is in the open position.

6. The container of claim 2, wherein the first crushed zones and the second crushed zones not contacting each other when the door is in the open position.

7. The container of claim 2, wherein one of the first and second crushed zones are spaced away from both the front panel.

8. The container of claim 1, wherein the door further includes a slit located between the support portion and the main portion to assist in movement of the door from the closed position to the open position.

9. The container of claim 1, further comprising a tear-away portion formed in the back panel, the tear-away portion being configured to be removed from the container to provide access to an interior of the container.

10. The container of claim 9, wherein a portion of the back panel remains after the tear-away portion is entirely removed from the container.

11. The container of claim 9, wherein the tear-away portion is further formed in the top panel and the bottom panel.

12. The container of claim 1, wherein the back panel includes a hook-access portion configured to provide access to a hook for hanging the container.

13. The container of claim 1, wherein the support portion is configured to rotate about the fold line from a first position to a second position, the support portion being generally parallel to the main portion in the first position, the support portion being oriented at an angle with respect to the main portion in the second position such that the support portion assists in retaining product in the container in the second position.

14. The container of claim 1, wherein the first side and second side are formed from a plurality of side flaps, the first side and the second side having a maximum thickness of three flaps.

15. The container of claim 14, wherein the first door-side portion and the second door-side portion are each located between two of the plurality of side flaps on the respective sides of the container.

16. The container of claim 1, wherein the door is hingedly connected to the bottom panel.

17. A blank for a container comprising:

a front panel;

a first end panel extending from the front panel;

a back panel extending from the first end panel;

a second end panel extending from the back panel;

a plurality of first side flaps, each of the plurality of first side flaps extending from a respective one of the front panel, the first end panel, the back panel, and the second end panel;

a plurality of second side flaps, each of the plurality of second side flaps extending from the respective one of the front panel, the first end panel, the back panel, and the second end panel; and a door including a door-front portion formed in the front panel, a first door-side portion formed in the first side flap extending from the front panel and a second door-side portion formed in the second side flap extending from the front panel, the first door-side portion and the second door-side portion including a first crushed zone on an interior surface of the blank, the first side flap extending from the front panel and the second side flap extending from the front panel each including a second crushed zone on an exterior surface of the blank.

18. The blank of claim 17, further comprising a tear-away portion formed in the first end panel, the back panel, and the second end panel.

19. The blank of claim 17, wherein the door-front portion includes a main portion and a support portion separated by a fold line.

20. The blank of claim 19, further comprising a slit between the main portion and the support portion.

21. The blank of claim 17, wherein the door-front portion is hingedly connected to the first end panel.

22. A container comprising:

a bottom;

a top opposing the bottom;

a front panel, a first side, a back panel, and a second side bridging the top and the bottom, the first side and the second side are each formed from a plurality of side flaps; and a door having a door-front portion, a first door-side portion, and a second door-side portion, the door-front portion being defined by a perforation extending across the front panel between the first side and the second side, the door being moveable between an open position and a closed position, the first door-side portion and the second door-side portion being located on opposite sides of the door-front portion, the first door-side portion and the second door-side portion extending inwardly from the door-front portion towards the back panel, the first door-side portion and the second door-side portion being configured to engage an interior surface of the front panel to stop movement of the door in the open position, the first door-side portion and the second door-side portion each being crushed on an exterior surface in a respective first crushed zone, one of the plurality of side flaps forming the first side and another of the plurality of side flaps forming the second side being crushed on an interior surface in respective second crushed zones.

23. The container of claim 22, wherein the first crushed zones are configured to contact the second crushed zones when the door is moved from the closed position to the open position such that the first door-side portion and the second door-side portion are forced inwards when the door is moved from the closed position to the open position.

24. The container of claim 22, wherein the first door-side portion is coplanar with the side flap having the second crushed zone that forms the first side when the door is in the closed position, and the second door-side portion is coplanar with the side flap having the second crushed zone that forms the second side when the door is in the closed position.

25. A container comprising:

a bottom;

a top opposing the bottom;

a front panel, a first side, a back panel, and a second side bridging the top and the bottom; a door defined by a perforation extending across the front panel between the first side and the second side, the door being moveable between an open position and a closed position, the door having the same thickness as the front panel; and a first door-side portion and a second door-side portion located on opposite sides of the door, the first door-side portion and the second door-side portion extending inwardly from the front panel towards the back panel, the first door-side portion and the second door-side portion being configured to engage an interior surface of the front panel to stop movement of the door in the open position wherein the first side and the second side are each formed from a plurality of side flaps, and wherein the first door-side portion and the second door-side portion are each coplanar with respective ones of the plurality of side flaps when the door is in the closed position, and wherein the first door-side portion and the second door-side portion are not coplanar with respective ones of the plurality of side flaps when the door is in the open position wherein the first door-side portion and the second door-side portion each being crushed on an exterior surface in a respective first crushed zone, one of the plurality of side flaps forming the first side and another of the plurality of side flaps forming the second side being crushed on a respective interior surface in a second crushed zone;

wherein the first crushed zones are configured to contact the second crushed zones when the door is moved from the closed position to the open position such that the first door-side portion and the second door-side portion are forced inwards when the door is moved from the closed position to the open position.

* * * * *